US011344763B1

(12) United States Patent
Karnes, Jr.

(10) Patent No.: US 11,344,763 B1
(45) Date of Patent: May 31, 2022

(54) FRICTION-SPREADER GRIP ASSEMBLY FOR RESISTANCE BAND EXERCISE

(71) Applicant: John H Karnes, Jr., Houston, TX (US)

(72) Inventor: John H Karnes, Jr., Houston, TX (US)

( * ) Notice: Subject to any disclaimer, the term of this patent is extended or adjusted under 35 U.S.C. 154(b) by 48 days.

(21) Appl. No.: 17/097,985

(22) Filed: Nov. 13, 2020

(51) Int. Cl.
*A63B 21/00* (2006.01)
*A63B 21/055* (2006.01)
*A63B 21/02* (2006.01)

(52) U.S. Cl.
CPC .... *A63B 21/00043* (2013.01); *A63B 21/0555* (2013.01); *A63B 21/0557* (2013.01); *A63B 21/028* (2013.01)

(58) Field of Classification Search
CPC ..... A63B 21/00043; A63B 21/40; A63B 21/0555; A63B 21/0557; A63B 21/028; A63B 21/4019; A63B 21/4017; A63B 22/0002; A61H 15/00; A61H 21/0557; A61H 21/0552; A61H 2205/088
See application file for complete search history.

(56) References Cited

U.S. PATENT DOCUMENTS

| | | | | |
|---|---|---|---|---|
| 8,986,173 | B1 * | 3/2015 | Adams | A63B 21/00069 482/106 |
| 9,974,993 | B1 * | 5/2018 | Pollock | A63B 21/4034 |
| 11,020,625 | B1 * | 6/2021 | Castle | A63B 21/0004 |
| 11,033,774 | B1 * | 6/2021 | Clarke | A63B 21/00185 |
| 2018/0125746 | A1 * | 5/2018 | Kokakis | A63B 21/4037 |
| 2018/0264304 | A1 * | 9/2018 | Pollock | A63B 23/035 |

* cited by examiner

*Primary Examiner* — Andrew S Lo
*Assistant Examiner* — Andrew M Kobylarz
(74) *Attorney, Agent, or Firm* — Donald R. Boys; Central Coast Patent Agency LLC

(57) ABSTRACT

A grip assembly has a core having a longitudinal axis and anchor interfaces on opposite ends, an exercise band with elastic properties, one end furled around the core, and the other, loose end extending away from the core, and a keeper strap having attachment interfaces at opposite ends compatible with the anchor interfaces of the core, the attachment interfaces engaged to the ancho interfaces of the core, the keeper strap spanning the length of the core, intimately contacting the furled exercise band. The keeper strap constrains the furled exercise band from unfurling.

15 Claims, 6 Drawing Sheets

FRICTION-SPREADER GRIP ASSEMBLY FOR RESISTANCE BAND EXERCISE

BACKGROUND OF THE INVENTION

1. Field of the Invention

The present invention is in the technical field of exercise and physical therapy equipment.

2. Description of Related Art

Strength is an essential component of the health and well-being for people of all ages. Generally, people tend to lose strength and muscle mass due to injury, inactivity, and the aging process. For older adults in particular strength plays an important role in several key functions. For example, strength is required for maintaining balance, preventing falls, and retaining bone density. Muscle loss is a condition that affects everyone but increases with age and so is especially acute in older people. Loss of muscle and flexibility are two of the major contributors to joint and other injuries in adults, especially the elderly, and can significantly diminish the quality of life of those effected and increase the cost to society of their medical care.

As the population ages over the coming decades, there will be an increasing need for basic exercise/rehabilitation apparatuses targeting critical muscle groups affected by aging that are simple, user-friendly, convenient, and inexpensive.

Resistance training is a well-known method in basic exercise/rehabilitation for maintaining, rebuilding, and increasing muscle mass for general fitness and rehabilitation. Resistance training is any exercise that causes the muscles to contact against an external resistance with the expectation of increases in strength, power, hypertrophy, or endurance. Resistance strengthening can be achieved by use of a variety of different methods which have historically been dominated by large, gym-type apparatuses such exercise machines, free weights, and circuit training units. A common drawback of all of these methods, however, is that the apparatuses are expensive, require substantial space to house or require membership/commuting to a special facility, cannot be used at home or while traveling, require spotters or third-party assistance, are complicated to operate, and importantly do not offer refinements in terms of resistance levels of adjustments or movement required for many strengthening and rehab exercises, especially non-linear movements and work movements involving short spans of travel, such as those used for wrists, elbows, and shoulders.

Due to the above-described shortcomings of traditional gym-type strengthening and rehab apparatuses, there has been an emergence of exercise bands and tubes, generically called "resistance bands," that allow replication of certain of the resistance benefits and exercises performable with legacy gym-type weight training apparatuses with much lower cost, increased portability and convenience (and home use), and enhanced effectiveness.

The term "resistance band" is not used consistently in prior art or in real world parlance. What are commonly referred to in prior art/common nomenclature as "resistance bands" can be divided into two categories. On the one hand there are lengths of solid, flat sheet-like material typically rendered in elongated, tape-like strips and typically sold and stored on rolls; These meet the technical definition of a resistance band. On the other hand, there are lengths of hollow, elongated cylindrical material typically rendered as tubes which cannot be rolled onto itself; These are often called resistance bands (including throughout prior art) but are technically resistance tubes, not bands. While tubes and bands (depending on the material) do share certain similar elastic properties, their fundamentally different shape requires their separate classification, especially for purposes of appreciating the invention described herein. This is due in large part to the fact that resistance tubes, with their hollow center cavity, offer many more well-know and effective methods for attaching them to handles than are available for resistance bands which are not conducive to plug, ball, and other types of invasive expansion devices that are routinely used to create effective "stops" at the terminal end of a resistance tube.

For clarity, as used herein, the former above-referenced article (e.g., flat, tape-like material in rolls) is referred to herein as "resistance bands" while the latter will be referred to as "resistance tubes."

Furthermore, within the category of resistance bands, there are two categories of true resistance bands based on their configuration. First, there are undefined rolls of band material, sometimes referred to as "therapy bands" due to their initial proliferation in physical therapy use. These bands are linear, and uniform end to end, without special treatment at their terminations, tape-like in configuration and sold and stored on rolls, and capable of being cut into various lengths, without any joinder back or reattachment onto itself in any manner. The second category are articles of configured shapes comprised with band material but configured into closed loops or figure 8's of various sizes, without any termination points, in order to facilitate their grasp by users and/or to allow them to be clasped or looped (such as placing a loop around both ankles and exercising by exerting a spreading force to elongate the loop and result in exercise work).

For further clarity, the former uniform, un-joined type of resistance band typically dispensed in rolls will be sole subject matter going forward, unless expressly stated otherwise. The invention described has no application with respect to resistance tubes, or resistance bands of the second-type mentioned above that are closed loops or otherwise joined to themselves.

Importantly, by their very nature, resistance bands only generate resistance work in one direction: they typically involve only a drawing or pulling force. They are stretched to extend the material, employing strength-building work throughout the travel, and then allowed to relax or contract to their original position. This is in sharp contrast to a bench press, for example, which involves a pushing force, or a closed loop exercise band described above which is configured for a pushing motion.

Resistance bands have several key advantages over the use of gym-type exercise apparatuses in that they are inexpensive, simple, versatile, lightweight, and are capable of being used in almost any setting. They are also uniquely effective as compared to gym-type equipment in exercise and rehabilitation for several reasons. As compared to gym-type machines, bands are much more effective providing relatively short and/or non-linear pull motions. Bands also allow "micro adjustments" in length and resistance not achievable with gym-type equipment. And bands generally allow lighter resistance levels overall than are obtainable using gym-type equipment. As a result, resistance bands are frequently recommended as a form of resistance training for the elderly and those in physical therapy recovering from injuries or patients with low functional strength or for sports conditioning.

Despite the benefits of exercise with resistance bands, they suffer from numerous functional and property drawbacks which limit their usefulness and adoption, especially among the elderly, recuperating, and others who could derive a unique benefit from their properties.

Perhaps the largest of these limitations is a lack of grip and difficulty clasping the band during exercise. Given that the beneficial work resistance provided by resistance bands is generated through a pulling motion (elongating the band and creating increasing tension across the band), the shape of resistance bands with their flat, uniform tape-like configuration and undefined terminations with no handle make them very hard to clasp while exerting force in a pulling potion. At most basic, exercising with resistance bands, which typically involves tensioning the bands between two diverging extremities (such as stretching a band between with your hands) or between one extremity and a fixed object (such as tying one end to a pole) requires the user to clench the band with their hands or wrap the band around their hands. For the elderly and those in rehab, clenching resistance bands with the hand can be difficult and painful, and can exacerbate arthritis and similar joint conditions, as well as aggravating convalescing injuries. This situation is severely compounded by the introduction of perspiration in workout contexts, where loss of grip allows the band to snap back in an uncontrolled fashion which can cause injury. If the grip is lost during the motion of the exercise while the band is elongated, the energy of the band is released causing the band to violently snap back to its original shape. This frustrates the benefit of the exercise, impairs the workout experience, and has the potential to cause serious injury.

Another problem with resistance bands is they tend to adhere or stick to themselves over time. The natural property of elastic material, whether rubber, latex or otherwise, is to adhere to itself when left folded, bunched, or gathered, such as in a locker or bottom of a gym bag. Left hanging or bunched in a gym bag, a resistance band can become semi-permanently attached to itself. Separating the band, essentially peeling the band apart to return it to its usable shape, requires significant dexterity, takes time, and weakens the integrity of the band. Moisture from work-out perspiration tends to migrate to folded areas where it is retained, amplifies adhesion, and accelerates breakdown and rot. With no solution available in prior art, the constant sticking-and-unsticking process associated with resistance bands takes time and reduces convenience, adds to the cost of more frequent replacement, and creates significant safety risk of pre-mature band failure.

Compounding the sticking issue attendant to resistance bands is the fact that common practice and all prior art inventions (expect perhaps one) address the difficulty grasping bands by "bunching" the resistance band, often tying the band in a knot, to create a "stop" feature in the band allowing more effective clenching of the band or to prevent the band from pulling through an eye or other retention device. In either case, this forces the band into "gathers" which changes the resistance properties of the band resulting in a less distributed, balanced, and smooth pulling motion during expansion and contraction. The bunching of the resistance band into gathers also shortens the life of the resistance band and renders the action of the band more similar to a resistance tube than the band as intended.

The most common solution for gripping is for users to wrap the resistance band around their hands. This, in addition to arthritis and other risks mentioned above, also creates the risk of lost circulation and potential nerve damage over time, especially in elderly users.

To address the clenching issue a variety of "handles" and handle-type devices have been proposed.

Handle-type implementations, while constructive to the problem, involve a number of inherent shortcomings that have precluded their widespread adoption. Major continuing challenges not addressed are the complexity of attaching the resistance band to the handle and the risk of mechanical attachment failure. A major challenge inherent with any handle-type solution is inadvertent separation of the resistance prior are handles (most of which apply only to resistance tubes and not resistance bands) embody band from the handle mechanism, which can cause the band to snap back toward the user, possibly causing injury. To mitigate the risk of attachment failure, prior are handles (most of which apply only to resistance tubes and not resistance bands) embody mechanisms to secure the band to the handle frame with a variety of In order to adjust the length of the band, these mechanisms must be loosened and re-tightened which can be time-consuming and difficult for elderly or convalescing users. Moreover, these items can fail without warning, allowing the band to snap back, and moreover involve numerous small parts capable of being projected by the band if it dislodges and forcibly contracts.

Safety issues aside, most proposed solutions involve moving parts used to clamp a gathered (or in a few cases spread) resistance band that must be manipulated by the user, loosing and tightening screws or impingers for adjustment, and which require additional manufacturing and assembly steps. As a result, the current state solutions in the art is time consuming, requires manual dexterity, creates a failure hazard, and limits the overall experience of the workout. Another significant drawback inherent in handles is that they do not accommodate exercises involving "short-pull" travel ranges, especially those where the starting points of the exercise movement are relatively close together.

Another unmet need is the fact that handles are of a fixed diameter and are not interchangeable. The inventor believes that allowing adjustment of the diameter of a hand grip in a pulling exercises may be a very effective technique in exercising different muscle groups including wrist, forearm, elbow, and even the shoulder. For example, increasing the diameter of the pull handle in any pull exercise can be very effective in strengthening the muscles and tendons involved in tennis elbow and similar ailments affecting the forearm and elbow.

Lastly handles in the art typically do not allow micro adjustments in the length of the resistance band. The inventor believes an ability to make minor adjustments in the length of pull may be important for comfort, proper alignment, maximum work, and appropriate resistive tension. Changing length of the resistance band in minor increments may be very important to calibrate exercise work in two important respects. First, it is important to start the range of movement of each exercise at the appropriate position of the exercise extremity relative to the orientation of the exercise.

In a similar vein, the amount of resistance applied by a resistance band increases as the band is stretched and advances from its resting length toward its maximum extended length. Making micro adjustments to the length of the band may be a very effective way to quickly and effectively increase or decrease work and stress achieved in an exercise, which is especially important in short pull exercises. Because prior art proposals rely on mechanical clamps, buckles, and impingers and the like to secure the band to the arms of the handle, it is not possible to make minor adjustments quickly to the length of pull—and thus the amount of work accomplished—during work out.

Therefore, what is clearly needed is a simple, inexpensive, and easily manipulated apparatus that will allow resistance band users the benefits of resistance band exercise in strengthening and physical therapy without the discomfort and potential harm associated with attempting to grasp the terminal end of the band, or wrapping the band around the hand, that will address the inconvenience and potential harm associated with the "sticking" problem inherent with bands, that allow for quick adjustments in pull length and micro adjustments, and that will facilitate short-pull exercises involving lengths of bands that are too short for use in prior art suitcase handle-type inventions.

BRIEF SUMMARY OF THE INVENTION

In one embodiment of the invention a grip assembly is provided, comprising a core having a longitudinal axis and anchor interfaces on opposite ends, an exercise band with elastic properties, one end furled around the core, and the other, loose end extending away from the core, and a keeper strap having attachment interfaces at opposite ends compatible with the anchor interfaces of the core, the attachment interfaces engaged to the ancho interfaces of the core, the keeper strap spanning the length of the core, intimately contacting the furled exercise band. The keeper strap constrains the furled exercise band from unfurling.

In one embodiment the anchor interfaces are button anchors and the attachment interfaces of the keeper strap are rubber or rubber-loke loops engaged over the button anchors. Also, in one embodiment the core is cylindrical. In one embodiment the core is a hollow plastic construction. And in one embodiment the assembly further comprises an elastic safety strap having attachment loops at opposite ends engaging the anchor interfaces such that a user gripping the grip assembly around the furled portion of the safety strap inserts the hand under the elastic safety strap.

In one embodiment the assembly further comprises an eyelet loop at one end of the core, and a safety tether having a wrist loop and a connected attachment loop, the attachment loop engaged to the eyelet loop on the core, such that a user inserts the hand through the wrist loop of the tether before gripping the friction-spreader grip, the safety tether constraining the grip assembly in event of accidental release from the user's hand.

In another aspect of the invention a method for exercise with an exercise band is provided, comprising wrapping a first length of the exercise band a plurality of turns around a core having a longitudinal axis and anchor interfaces on opposite ends, leaving a first length of the exercise band extending away from the core to an extended end, engaging a keeper strap having attachment interfaces at opposite ends, by the attachment interfaces to the anchor interfaces of the core, such that the he keeper strap spans the length of the core, contacting the furled exercise band over a full length of the core, anchoring the extended end of the exercise band to a stationary anchor, gripping the core by one hand over and around the plurality of turns of the exercise band, and moving the core toward and away from the stationary anchor.

In one embodiment of the method the anchor interfaces on the ends of the core are button anchors and the attachment interface of the keeper strap are rubber-like loops, comprising engaging the loops over the button anchors. Also in one embodiment the method further comprises engaging an elastic safety strap having attachment interfaces at opposite ends to the anchor interfaces of the core, such that a user gripping the grip assembly inserts the hand under the elastic safety strap, which aids in gripping the grip assembly. In one embodiment the anchor interfaces on the ends of the core are button anchors and the attachment interface of the elastic safety strap are rubber-like loops, comprising engaging the loops over the button anchors.

In one embodiment the method further comprises attaching a safety tether to an eyelet loop at one end of the core by an attachment loop, the attachment loop connected to a wrist loop, such that a user inserts the hand through the wrist loop of the tether before gripping the friction-spreader grip, the safety tether constraining the grip assembly in event of accidental release from the user's hand. And in one embodiment the method further comprises releasing one end of the keeper strap from the core and adjusting the length of the portion of the exercise band furled on the core.

In another aspect of the invention a method for exercise with an exercise band is provided, comprising wrapping a first length of the exercise band a plurality of turns around a first core having a longitudinal axis and anchor interfaces on opposite ends, leaving a length of the exercise band extending away from the first core, engaging a first keeper strap having attachment interfaces at opposite ends, by the attachment interfaces to the anchor interfaces of the first core, such that the he keeper strap spans the length of the first core, intimately contacting the furled exercise band over a full length of the first core, wrapping a portion of the length of the exercise band extending away from the first core a plurality of turns around a second core having a longitudinal axis and anchor interfaces on opposite ends, engaging a second keeper strap having attachment interfaces at opposite ends, by the attachment interfaces to button anchor interfaces of the second core, such that the second keeper strap spans the length of the second core, intimately contacting the furled exercise band over a full length of the second core, and gripping the cores with opposite hands and exercising by stretching and releasing the exercise band between the two cores.

In one embodiment of this method the anchor interfaces on the ends of the cores are button anchors and the attachment interfaces of the keeper straps are rubber-like loops, comprising engaging the loops over the button anchors. And in one embodiment the method comprises releasing the keeper strap on one of the cores and adjusting the length of the portion of the exercise band extending between the first and the second core.

DETAILED DESCRIPTION OF THE INVENTION

The inventor provides a unique system for a friction-spreader grip assembly enabling safe, comfortable, and efficient exercise employing resistance bands that overcomes significant drawbacks of resistance band apparatus in current practice. The present invention is described in enabling detail in the following examples, which may represent more than one embodiment of the present invention.

Figure 1A:
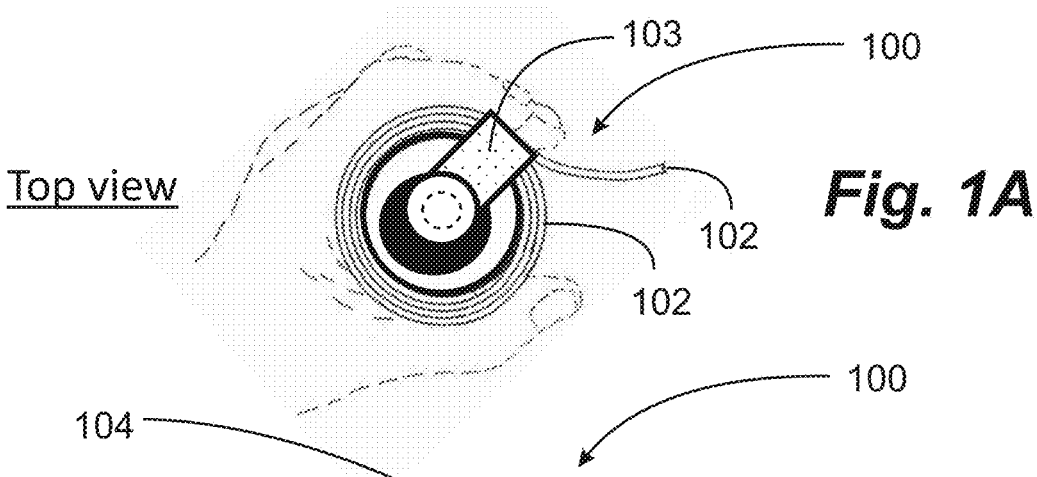
FIG. 1A is a top perspective view of a friction-spreader grip assembly according to an embodiment of the present invention.
Figure 1B:
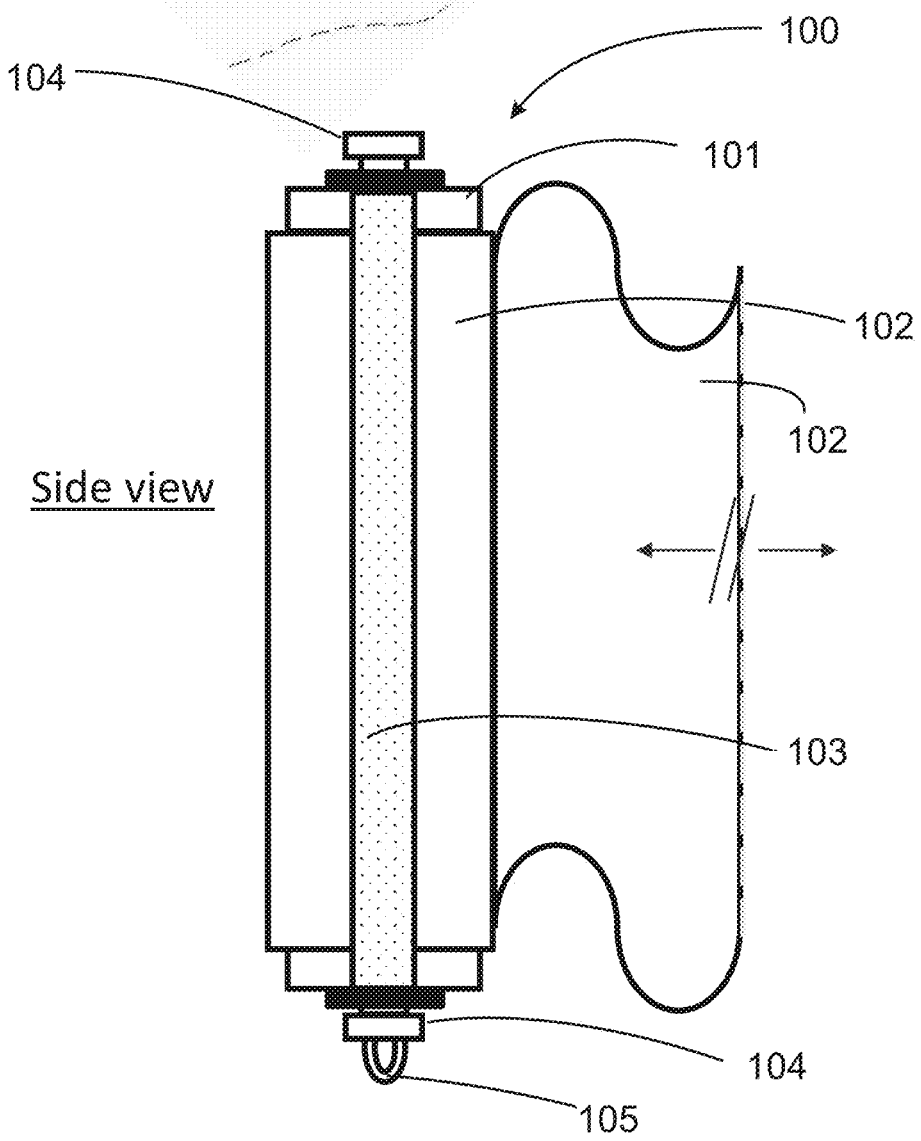
FIG. 1B is an elevation view of the assembly of FIG. 1A.

FIG. 1A is a top view of a friction-spreader grip assembly 100 according to one embodiment of the present invention. FIG. 1B is an elevation perspective view of assembly 100 of FIG. 1A. For drawing simplicity, a loose, unfurled end of an exercise band 102 is shown cropped, but in application might be furled/unfurled from time to time to adjust to any length suiting the user's precise exercise needs for the intended movement. In this embodiment, friction-spreader grip assembly 100 comprises a furling-spreader core 101, a length of exercise band 102 with elastic properties, which is furled/unfurled around furling-spreader core 101, and a keeper strap 103 with elastic properties attached at each end of furling-spreader core 101 so as to traverse snugly across band 102 to prevent unintended unfurling while in use. The principal elements disclosed in this embodiment are a furler-spreader core 101 around which flat, tape-like stretchable or elastic band material 102 (commonly known as resistance bands including those widely sold under the brand Thera-Band) may be furled. Keeper strap 103 prevents band 102 from unfurling unintentionally and provides for incremental adjustment of a total length of strap 102 that may be in play at any point in time. An unfurled tail portion of band 102 can be shortened by furling or lengthened by unfurling, from time to time, in either case once keeper strap 103 is released, to suit the user's needs for their particular exercise. Furler-spreader core 101 in this example is generally elongated and cylindrical in shape, so the user can easily and comfortably furl band 102 around the core and hold friction-spreader grip assembly 100 in one hand with a firm and comfortable grip with fingers encompassing and surrounding all or a portion of friction-spreader grip assembly 100 (including furler-spreader core 101, furled portion of band 102, and keeper strap 103) as a single entity. Different versions of furler-spreader core 101 can be solid, hollow, or composite, and may include internal strengtheners and/or anchoring points allowing for various ways of fastening and safety system attachments.

As to composition, embodiments of furler-spreader core 101 may include any material stiff and strong enough the achieve spreading or distributing of all or part of the pull force of band 102 across the length of furling-spreader core 101, including wood, PVC, plastic, metal, polymer, composite, or any other suitable material, and may be rigid, semi-rigid or soft. As to shape, embodiments of furler-spreader core 101, in addition to the embodied cylindrical shape disclosed in this embodiment of furler-spreader core 101, may be of any other shape or contour, including oval, triangular, square, custom form, other otherwise, that is comfortable to hold in the hand, ample to furl band 102, accommodates keeper strap 103, and allows friction to act to contribute to holding band 102 fast to furler-spreader core 101 (and immediately adjacent band 102 layer(s)). As to overall proportion, embodiments of furler-spreader core 101 may be of any length and circumference, and are intended to vary relative to the width of band 102 employed (implicating the height of the friction-spreader grip assembly 100) and of various circumferences around for comfort in the hand and to target additional muscle groups including in the wrist, forearm, elbow, and shoulder. This example depicts button anchors 104 at end points on furler-spreader core 101 to attach keeper strap 103, as well as an eyelet anchor 105 at one end of furler-spreader core 101.

Figure 2A:
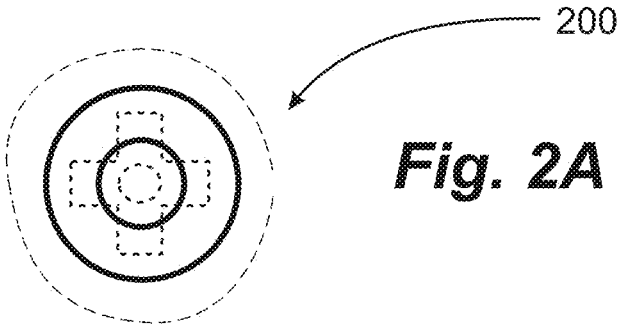
FIG. 2A is a top view of a friction-spreader grip assembly according to a further embodiment of the present invention.
Figure 2B:
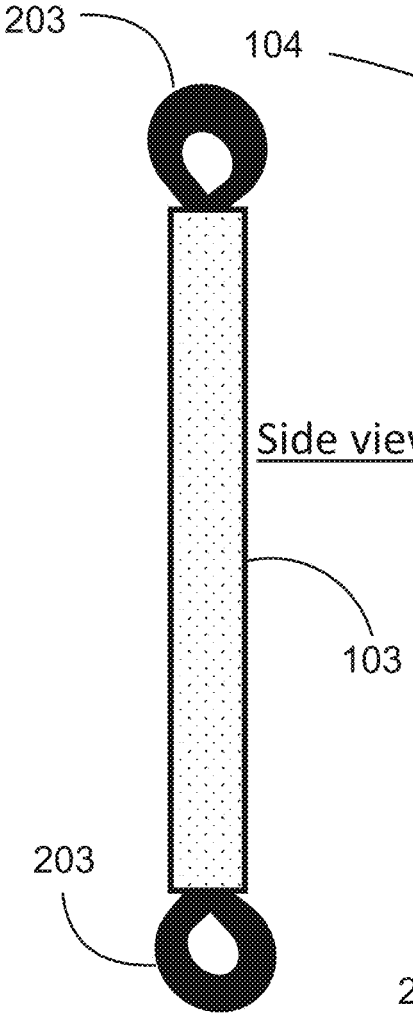
FIG. 2B is an elevation view of a keeper strap separate from the assembly
Figure 2C:
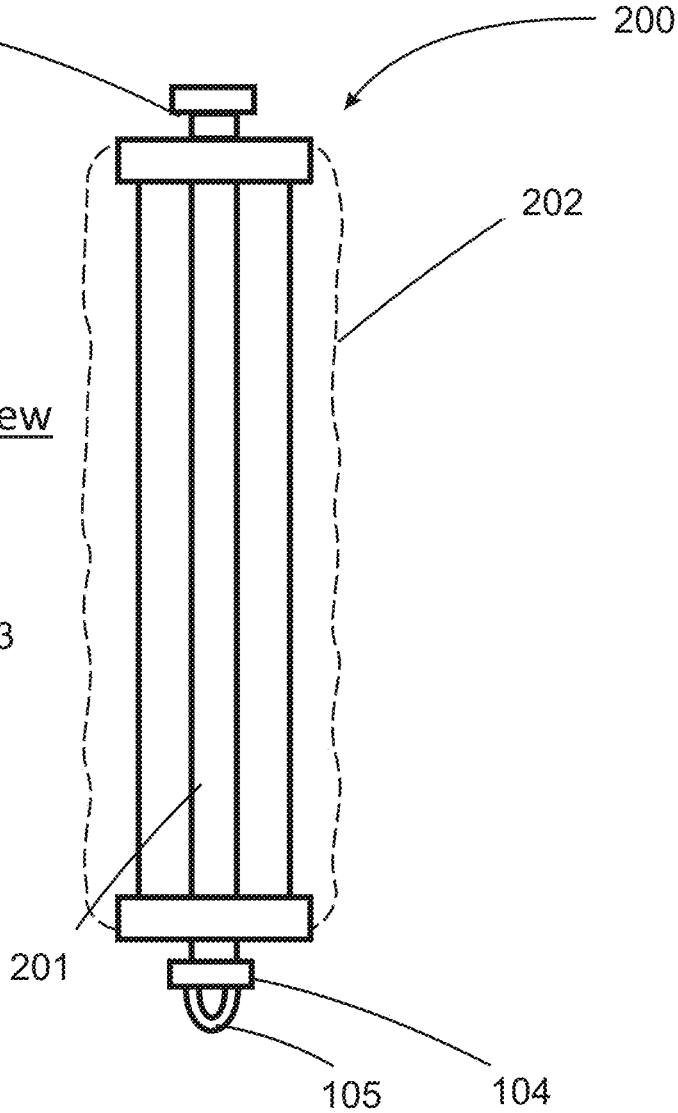
FIG. 2C is a side elevation view of the assembly of FIG. 2A.

FIG. 2A is a top perspective view of a friction-spreader grip assembly 200, and FIG. 2C is an elevation view of assembly 200. Band 103 with end loops 203 is shown separately as FIG. 2C. End loops 203 in this example may be rubber, or a rubber-like material that can be stretched over button anchors 104. This further embodiment includes components that were previously included in FIG. 1. Those components previously introduced that have not changed in this example retain their original element number and are not reintroduced. Also note that for simplicity FIG. 2A omits band 102 in its entirety and keeper strap 103 is detached and shown in an un-tensioned state. In this example, furler-spreader core 200 is depicted as two-part construction with an inner stiffener support 201 molded internal to a padded or semi-soft surrounding material for comfortable gripping yet sufficiently firm, dense, and supportive to give shape to furler-spreader core 200 and support furling of band 102 (not shown) in or out to adjust the length to accommodate the user's exercise once keeper strap 103 (depicted detached from button anchors 104 for illustration) is released at one end.

Figure 3A:
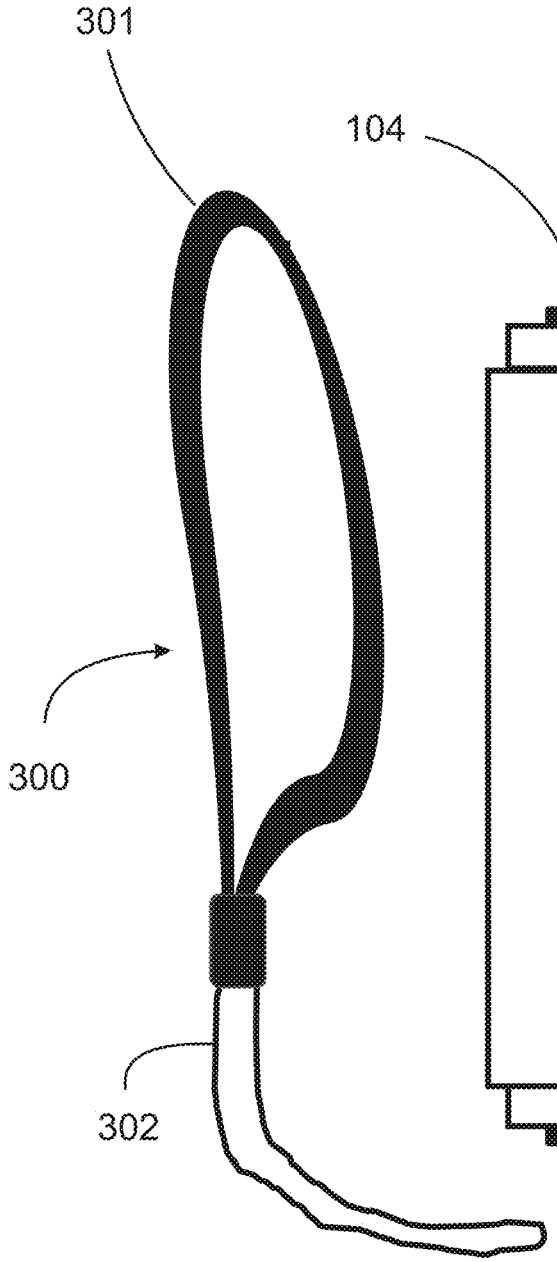
FIG. 3A is an elevation view of a safety tether strap in an embodiment of the invention.
Figure 3B:
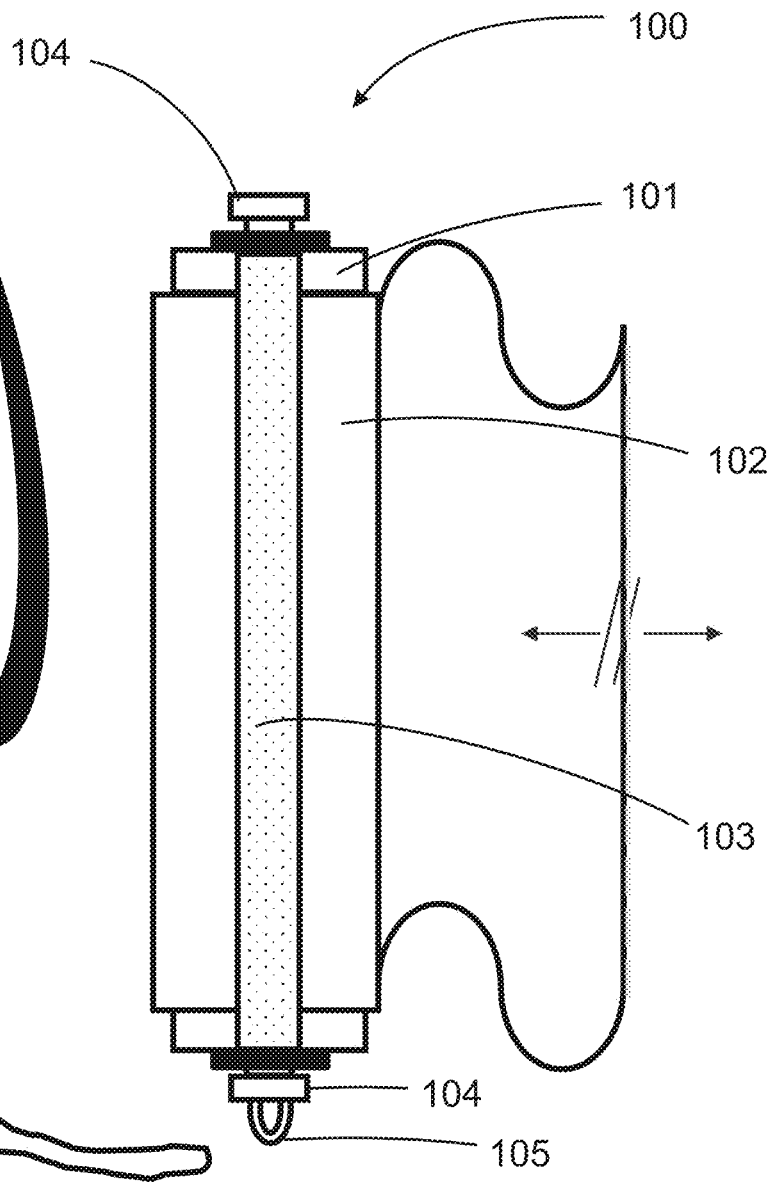
FIG. 3B is an elevation view of a friction-spreader grip assembly core according to a further embodiment of the present invention.

FIG. 3B is an elevation perspective view of friction-spreader grip assembly 100 according to a further embodiment of the present invention. This further embodiment includes components that were previously included in FIG. 1. Those components previously introduced that have not changed in this example retain their original element number and are not reintroduced. FIG. 3A illustrates a safety tether 300 that may be fastened to eyelet anchor 105 to prevent accidental, uncontrolled release of friction-spreader grip assembly 100 from the user's hand in the event grip is lost during exercise while band 102 is under tension. Tether 300 comprises a fabric or cord loop 301, and a connecting string or cord 302 that may be attached to eyelet 105. A user may put loop 301 over the hand on the wrist for example.

Figure 4:
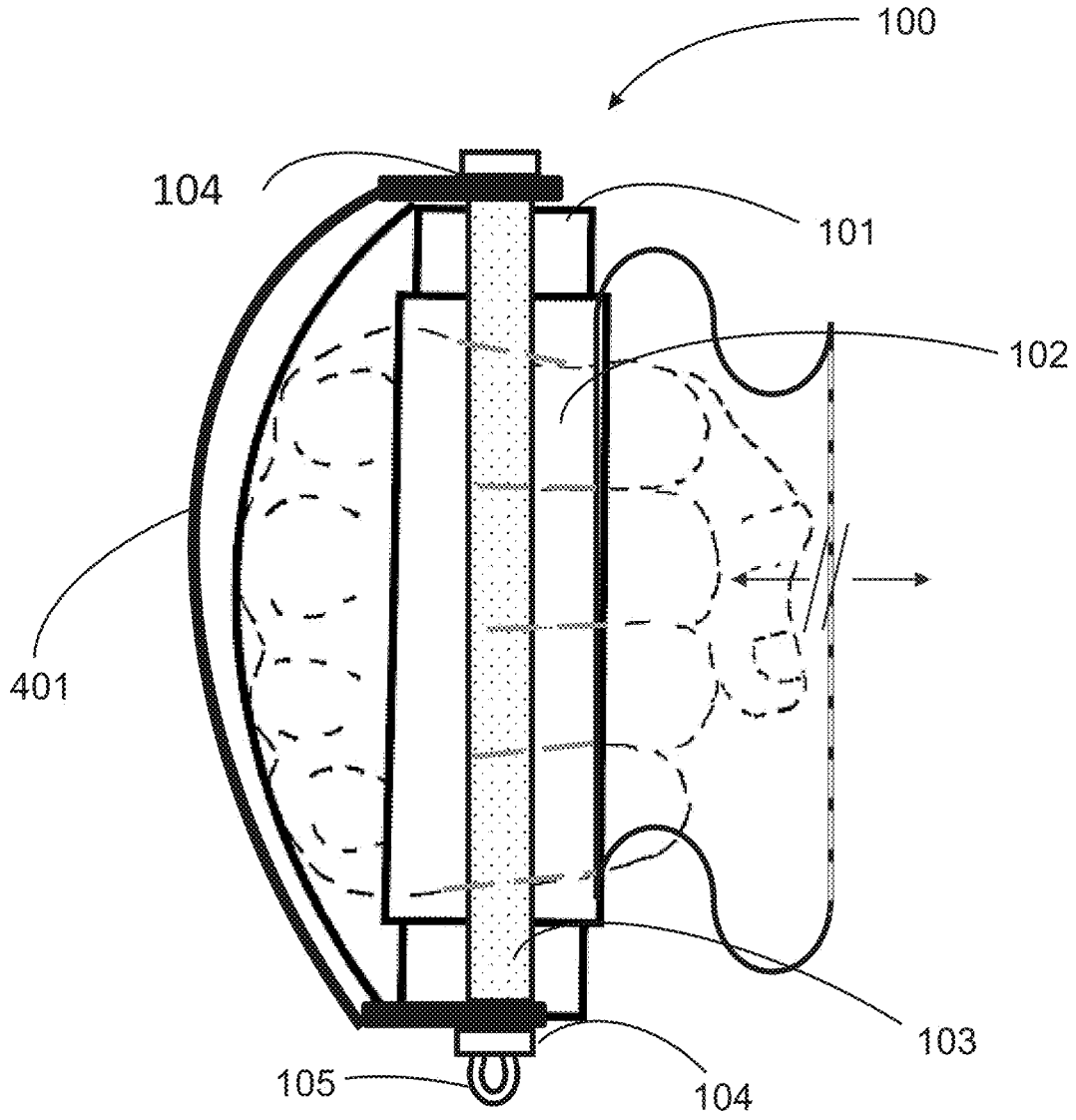
FIG. 4 is an elevation perspective view of a friction-spreader grip assembly according to a further embodiment of the present invention.

FIG. 4 is an elevation perspective view of friction-spreader grip assembly 100 according to a further embodiment of the present invention. In this example friction-spreader grip assembly 100 is depicted with a safety strap 401 added to prevent accidental, uncontrolled release of friction-spreader grip assembly 100 from the user's hand in the event grip is lost during exercise while band 102 is under tension. Safety strap 401 may be fabric or a supple polymer and includes end loops to attach to anchors 104. The end loops may be rubber or rubber-like material to stretch over button anchors 104. The button anchors may, in some circumstances, be adapted to accommodate both the keeper strap 103 and the safety strap 104.

Figure 5:
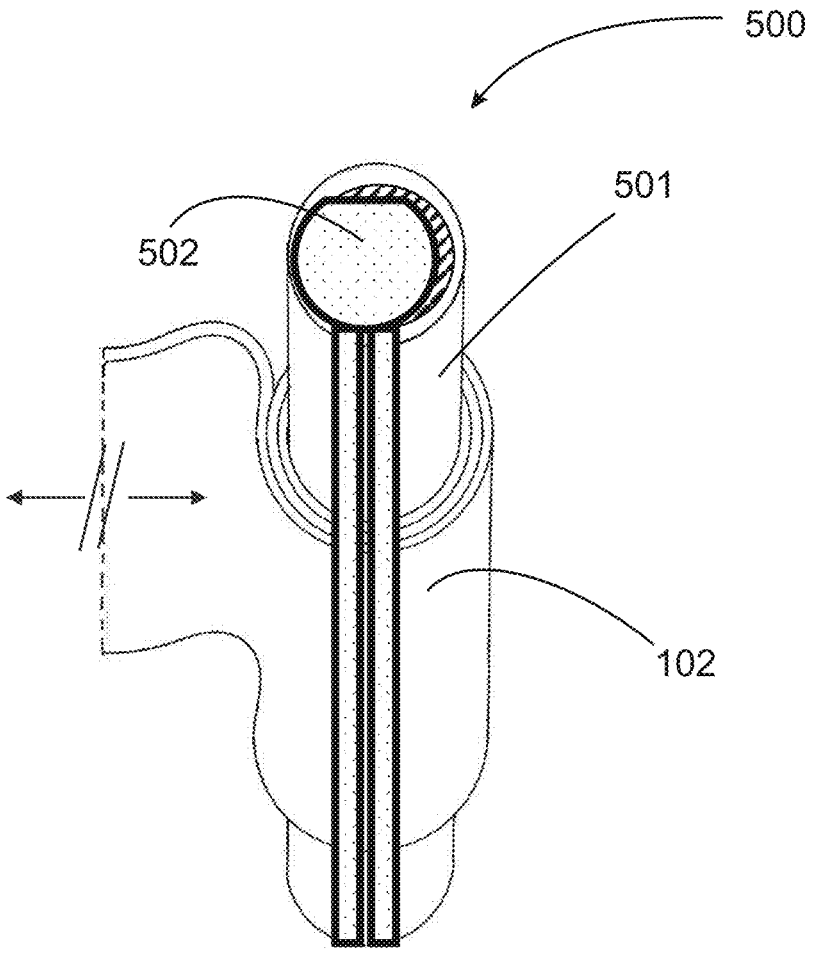
FIG. 5 is a dimensional perspective view of a friction-spreader grip assembly according to a further embodiment of the present invention.

FIG. 5 is a dimensional perspective view of a friction-spreader grip assembly 500 according to a further embodiment of the present invention. In this example friction-spreader grip assembly 500 employs a hollow furler-spreader core 501, around which band 102 is furled, and through which has been threaded a different version of a keeper strap 502 consisting of a knob-ended, loop-shaped fastener of "bungee cord" type construction which has been attached back onto itself at the knob end. Keeper strap 502 snugly spans the length of furler-spreader core 501, thereby traversing over band 102 to prevent band 102 from unintended unfurling and to preserve the length of the unfurled tail of band 102 at a predetermined interval while allowing convenient detachment/re-attachment of keeper strap 502 to allow the user to furl in or furl out band 102 length from time to time as desired for the user's intended exercise. Embodiments of the keeper strap 502 may be of rubber, elastic or other stretchable materials, as well as semi-stretchable and static materials such as nylon, and include both strap (e.g., flat, tape-like shapes), round cords (including looped cords), tubes or any other shape material, and of any desired, comfortable shape, texture, and thickness.

Figure 6:
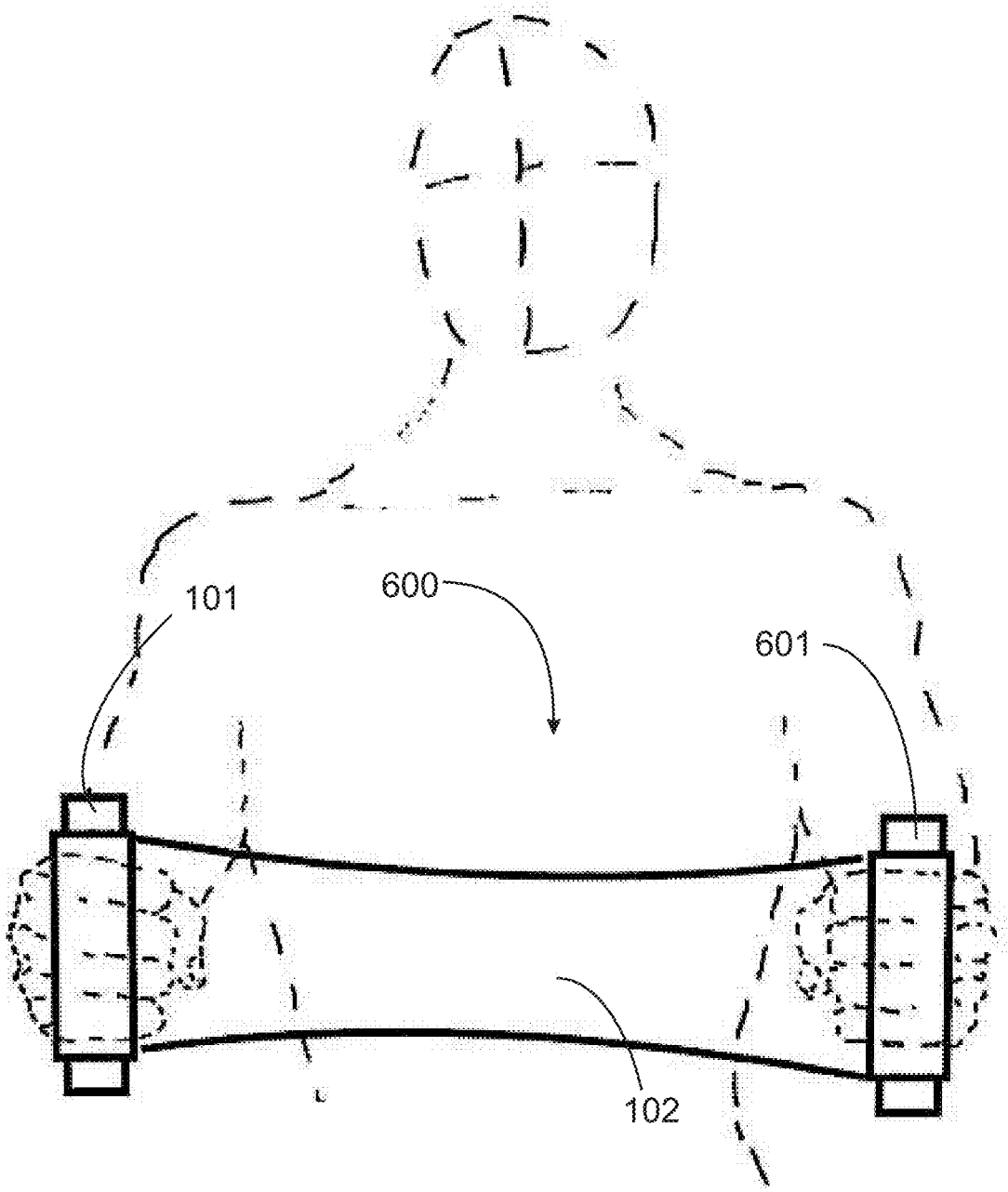
FIG. 6 is an illustration of a method of employing a friction-spreader grip assembly according to a further embodiment of the present invention.

FIG. 6 is a frontal elevation view illustrating a method of using friction-spreader grip assembly 100 according to an embodiment of the present invention. In this example, a preferred embodiment of friction-spreader grip assembly 100 (keeper strap 103 is not shown in drawing for simplicity) is depicted teaching a method of incorporation of a second furler-spreader core 601 and second keeper strap 103 (not shown for simplicity) (which may be similar to furler-spreader core 101 and keeper strap 103 in FIG. 1, or may employ a different embodiment of functionally similar outcome) into friction-spreader grip assembly 100 by furling the loose end of band 102 (e.g. the end not furled around furler-spreader core 101 comprising an element of friction-spreader grip assembly 100 as described) around furler-spreader 601 (employing a second keeper strap 103, which is not shown for simplicity) thereby allowing two friction-spreader grip assemblies (101 and 601)—sharing a common band 102 in their integration—as a single entity to accomplish comfortable, balanced, highly effective pull-type, opposing resistance exercises, as discussed above, of the type frequently prescribed by doctors and physical therapists to strengthen and improve shoulder stability in rehabilitation and for general wellbeing.

FIG. 6 is intended to demonstrate how friction-spreader grip assembly 100 might be gripped in the user's hands during exercise with both furler-spreader core 101 and furled resistance band 102 resting in the palm of the hand and clenched fingers extending around and clasping friction-spreader grip assembly 100 and furled band 102 as an entity, with thumb in an opposing position, and the loose, unfurled end of band 102 furled around opposing furler-spreader core 101.

An object of this example exercise method is to start with band 102 in a relaxed, un-tensioned state, and elbows bent at 90 degrees and held inward against the torso in a hinging movement while the hands are spread apart maintaining a constant plane parallel to the ground until fully extended sideward. For contextual purposes, the length of the draw of band 102 in this movement may begin at 20" and might conclude at full extension at 50" (assuming a 6'0" male subject). As mentioned above, this stretch ratio, 2.5 to 1.0, is the maximum safe length of draw recommended in industry publications. It will be apparent to one with skill in the art that the friction-spreader grip assembly of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

The invention claimed is:

1. A grip assembly comprising:

a core having a longitudinal axis and anchor interfaces on opposite ends of the core;

an exercise band with elastic properties, having a first end connected to and furled around the core and a second end extending from the core; and a keeper strap having attachment interfaces at opposite ends of the keeper strap attachable to the anchor interfaces of the core, the attachment interfaces engaged to the anchor interfaces of the core, the keeper strap spanning a length of the core, intimately contacting the furled exercise band;

wherein the keeper strap constrains the furled exercise band from unfurling.

2. The grip assembly of claim 1 wherein the anchor interfaces are button anchors and the attachment interfaces of the keeper strap are rubber or rubber-like loops engaged over the button anchors.

3. The grip assembly of claim 1 wherein the core is cylindrical.

4. The grip assembly of claim 1 wherein the core is a hollow plastic construction.

5. The grip assembly of claim 1 further comprising an elastic safety strap having attachment loops at opposite ends of the elastic safety strap engaging the anchor interfaces such that a user gripping the grip assembly around the furled portion of the safety strap inserts a hand under the elastic safety strap.

6. The grip assembly of claim 1 further comprising an eyelet loop at one end of the core, and a safety tether having a wrist loop and a connected attachment loop, the attachment loop engaged to the eyelet loop on the core, such that a user inserts a hand through the wrist loop of the tether before gripping the the grip assembly, the safety tether constraining the grip assembly in event of accidental release from the user's hand.

7. A method for exercise with an exercise band, comprising:

providing a grip assembly having a core with a longitudinal axis and anchor interfaces on opposite ends of the core, an exercise band with elastic properties, the exercise band having a first end connected to and furled around the core and a second end extending from the core, and a keeper strap having attachment interfaces at opposite ends of the keeper strap attachable to the anchor interfaces of the core, the attachment interfaces engaged to the anchor interfaces of the core, with the keeper strap spanning a length of the core, intimately contacting the furled exercise band;

anchoring the second end of the exercise band to a stationary anchor;

gripping the grip assembly by one hand; and moving the grip assembly toward and away from the stationary anchor.

8. The method of claim 7 further comprising engaging an elastic safety strap having attachment interfaces at opposite ends to the anchor interfaces of the core, such that a user gripping the grip assembly inserts the one hand under the elastic safety strap, which aids in gripping the grip assembly.

9. The method of claim 8 wherein the anchor interfaces on the ends of the core are button anchors and the attachment interfaces of the elastic safety strap are rubber-like loops, engaging the loops over the button anchors.

10. The method of claim 7 wherein the anchor interfaces on the ends of the core are button anchors and the attachment interfaces of the keeper strap are rubber-like loops, engaging the rubber-like loops over the button anchors.

11. The method of claim 7 further comprising attaching a safety tether to an eyelet loop at one end of the core by an attachment loop, the attachment loop connected to a wrist loop, such that a user inserts the one hand through the wrist loop of the tether before gripping the grip assembly, the safety tether constraining the grip assembly in event of accidental release from the user's hand.

12. The method of claim 7 further comprising releasing one end of the keeper strap from the core and adjusting the furled portion of the exercise band furled on the core.

13. A method for exercise with an exercise band, comprising:

providing a first grip assembly having a core with a longitudinal axis and anchor interfaces on opposite ends of the core, an exercise band with elastic properties, the exercise band having a first end connected to and furled around the core and a second end extending from the core, and a keeper strap having attachment interfaces at opposite ends of the keeper strap attachable to the anchor interfaces of the core, the attachment interfaces engaged to the anchor interfaces of the core, with the keeper strap spanning a length of the core, intimately contacting the furled exercise band;

providing a second grip assembly having a second core with a longitudinal axis and second anchor interfaces on opposite ends of the second core, with the second end of the exercise band connected to and furled around the second core, and a second keeper strap having second attachment interfaces at opposite ends of the second keeper strap attachable to the second anchor interfaces of the second core, the second attachment interfaces engaged to the second anchor interfaces of the second core, with the second keeper strap spanning a length of the second core, intimately contacting the furled exercise band; and gripping the first and second grip assemblies with opposite hands and exercising by stretching and releasing the exercise band between the two grip assemblies.

14. The method of claim 13 wherein the anchor interfaces on the ends of the two cores are button anchors and the attachment interfaces of the keeper straps are rubber-like loops, comprising engaging the rubber-like loops over the button anchors.

15. The method of claim 13 comprising releasing the keeper strap on one or both of the two cores and adjusting a length of a portion of the exercise band extending between the first and the second gripper assemblies.

* * * * *